US005190383A

United States Patent [19]

Suzuki et al.

[11] Patent Number: 5,190,383

[45] Date of Patent: Mar. 2, 1993

[54] DOT PRINTING APPARATUS

[75] Inventors: Yoshihumi Suzuki, Ena; Yoshiyuki Ikezaki; Akira Iriguchi, both of Nagoya, all of Japan

[73] Assignee: Brother Kogyo Kabushiki Kaisha, Nagoya, Japan

[21] Appl. No.: 902,989

[22] Filed: Jun. 23, 1992

[30] Foreign Application Priority Data

Jun. 26, 1991 [JP] Japan ..... 3-181740

[51] Int. Cl.[5] ..... B41J 3/02

[52] U.S. Cl. ..... 400/124; 101/93.05; 310/316; 310/317; 400/157.2

[58] Field of Search ..... 400/124, 121, 157.2; 101/93.05; 310/316, 317, 318; 395/108

[56] References Cited

U.S. PATENT DOCUMENTS

| | | | |
|---|---|---|---|
| 4,348,119 | 9/1982 | Carson, Jr. et al. . | |
| 4,737,924 | 4/1988 | Miki | 400/124 |
| 4,743,821 | 5/1988 | Hall | 400/124 |
| 4,810,113 | 3/1989 | Itoh et al. | 400/124 |
| 4,844,635 | 7/1989 | Malkemes | 400/124 |
| 4,850,724 | 7/1989 | Fattori . | |
| 4,866,326 | 9/1989 | Niikawa et al. . | |
| 4,947,074 | 8/1990 | Suzuki . | |
| 5,030,020 | 7/1991 | Kikuchi et al. | 400/157.2 |
| 5,039,237 | 8/1991 | Tanuma et al. | 400/124 |
| 5,039,238 | 8/1991 | Kikuchi et al. | 400/124 |
| 5,078,517 | 1/1992 | Hiroshi et al. | 400/124 |
| 5,147,141 | 9/1992 | Sakaida | 400/124 |

FOREIGN PATENT DOCUMENTS 59-120465 12/1984 Japan .

OTHER PUBLICATIONS

IBM Technical disclosure Bulletin vol. 27, No. 12 dated May 1985 "Electronic Print Hammer Damping".

*Primary Examiner*—Eugene H. Eickholt

*Attorney, Agent, or Firm*—Kane, Dalsimer, Sullivan Kurucz, Levy, Eisele and Richard

[57] ABSTRACT

A dot printing apparatus in which the piezoelectric print head having the piezoelectric element connected to the printing wire is utilized and the secondary bounce of the printing wire is effectively controlled according to one of three dot printing modes (the normal continuous dot printing mode, the last dot printing mode in the continuous dot printing mode and the single dot printing mode), is disclosed. The dot is judged every time the dot printing is performed. And if judged the normal dot printing mode, the discharging of the piezoelectric element is conducted relatively fast after the dot printing in the present printing pitch is performed to charge the piezoelectric element, since the dot printing data exists in one or more printing pitches both before and after the present printing pitch, thus, the dot printing in printing pitch next to the present printing pitch is performed. And if judged the last dot printing mode, the electric energy stored in the piezoelectric element is partially removed at the first timing according to the discharging pulse with relatively narrow width, thereafter, the remained electric energy is completely removed. And further, if judged the single dot printing mode, the electric energy stored in the piezoelectric element is partially removed at the second timing later than the first timing according to the discharging pulse with the width wider than that in the last dot printing mode, thereafter, the remained electric energy is completely removed.

16 Claims, 13 Drawing Sheets

DOT PRINTING APPARATUS

BACKGROUND OF THE INVENTION

1. Field of the Invention

The present invention relates to a dot printing apparatus with a dot print head in which a plurality of printing wires are installed, and particularly to a printing apparatus in which the secondary bounce of the printing wires caused when the printing wires are returned to a fully retracted position can be effectively controlled.

2. Description of the Related Art

Generally, conventional dot printing apparatus performs dot printing on a print medium (sheet) by a print head with plural printing wires while moving the print head relatively to the print sheet according to a printing direction on the print sheet, and in such dot printing apparatus, dot printing is proceeded by pressing tops of the printing wires on the print sheet through that electric energy is supplied to or removed from a driving device of the print wires, each time the print head is relatively moved by one printing pitch.

In case that, for example, a type of piezoelectric print head having actuators with piezoelectric members as the driving device of the printing wires is utilized in the printing apparatus, and in such print head, a magnifying mechanism of displacement in the piezoelectric member to magnify displacement of the piezoelectric member activated and to transmit magnified displacement to the printing wires is arranged, and further the fully retracted position of the printing wires is elastically limited by the magnifying mechanism.

And in order to precisely limit the fully retracted position of the printing wires, it is conventionally proposed that a stopper located near the printing wires or near a parts moving with the printing wires is arranged in the magnifying mechanism and the fully retracted position of the printing wires is limited by contacting the wires or the parts to the stopper.

In that printing apparatus with such kind of the print head, a voltage is supplied for the piezoelectric member and removed therefrom according to printing command input from a control device. When supplying the voltage for the piezoelectric member, the printing wire is advanced to the printing position from the fully retracted position to press the print sheet since the piezoelectric member is displaced to a positive direction (printing direction). Contrarily, the printing wire is retrogressively returned to the fully retracted position from the print sheet since the piezoelectric member is displaced to a reverse direction (non-printing direction) when removing the voltage from the piezoelectric member.

On the other hand, it is possible to utilize the printing head, in which the printing wire is continuously biased to advancing direction (printing direction) by biasing means such as elastic element and the printing wire is not only returned to the fully retracted position upon supply of the voltage, but also advanced to the printing position upon removal of the voltage.

By the way, it is desirable for the dot printing apparatus to conduct dot printing as speedy as possible. To achieve this object, it is attempted in the dot printing apparatus that not only the time elapsed while the printing wire reaches to the printing position at which the top of the wire presses the print sheet from the fully retracted position, but also the time elapsed while the printing wire returns to the fully retracted position from the printing position are shortened by shortening the time necessary for both supply of the electric energy for the driving device and removal of the electric energy therefrom, as speedy as possible.

However, there is a limit in shortening the above returning time of the printing wire. Because, if the returning time is unnecessarily short, impact power occurring when the printing wire contacts with the stopper becomes excessively large in case that the fully retracted position is limited by the stopper because speed of the printing wire becomes too fast when reaching to the fully retracted position. Further, in case that the fully retracted position is limited by an element except for the stopper, the printing wire returns excessively over the fully retracted position. In all cases, secondary bounce (advancing movement to the printing direction) of the printing wire occurs based on reaction of the wire. Therefore, length of the returning time through the driving device has to be set to a time length so that the printing wire does not bounce to the print sheet to reprint the dot again thereon, thus, improvement of the printing speed in the apparatus is prevented by the above limitations.

To solve this problem, a dot printing apparatus is disclosed in U.S. patent application Ser. No. 07/426,773 now U.S. Pat. No. 5,147,141. In this dot printing apparatus, the printing wire is slowly returned if it is not necessary to perform next dot printing at a printing pitch within a predetermined range of the pitches after present dot printing is performed by slowly removing or supplying the electric energy in order to return the printing wire by spending longer time than a case in which next printing is necessary to perform within the predetermined range of the printing pitches. For instance, in case that dot printing is not necessary at a next printing pitch after a pitch where present dot printing is performed, removal or supply of the electric energy to return the printing wire after the present dot printing, is conducted slowly to spend longer time. And further, the removal or the supply of the electric energy to return the printing wire after the present dot printing, is conducted slowly to spend longer time than a case where at least one dot printing is necessary to be performed between the first printing pitch and the n-th (n: integer bigger than 2) printing pitch next to the present printing pitch, if it is not necessary to conduct dot printing in the range between the printing pitch where the present dot printing is conducted and the n-th printing pitch.

However, two types of dot printing modes, so-called a single dot printing mode and a continuous dot printing mode, may be conceivable. Here, the single dot printing mode means a printing mode in which dot printing data does not exist in one printing pitch or several printing pitches both before and after the present printing pitch in which dot printing data exists. And the continuous dot printing mode means a printing mode in which the dot printing data continuously exists in one printing pitch or several printing pitches before and/or after the present printing pitch in which dot printing data exists.

Therefore, in case that it is not necessary to conduct the dot printing in the predetermined range of the printing pitches after the present dot printing is conducted, the returning speed of the printing wire is changed according to whether the printing mode of the present dot printing is the single dot printing mode or the continuous dot printing mode, if only the same condition for inhibiting bounce of the printing wire is applied every time. As a result, bounce of the printing wire cannot be preferably inhibited, thus, behavior of the printing wire in the dot printing may be disordered.

Accordingly, if next printing command is input when the bounded printing wire is advancing to the printing position, the print sheet is torn or the printing wire is broken due to excessive impact power caused by the rebounced printing wire. On the contrary, if the next printing command is input when the printing wire is returning to the fully retracted position, the dot printing may not be efficiently conducted, whereby omission of the dots or light and shade of the dots may occur. Further, there is a problem that the printing wire may stick a printing ribbon based on discrepancy in input timing of the printing command.

Additionally, characteristic of the secondary bounce caused when the printing wire returns to the stopper is influenced by thickness of the print sheet. If the print sheet becomes thicker and thicker, the printing wire will return quickly from the print sheet since the top of the printing wire will contact with the print sheet faster than a case that the print sheet is thin. Therefore, the problem as same as above exist because the impact power caused between the printing wire and the stopper become unequal according to thickness of the print sheet.

SUMMARY OF THE INVENTION

Therefore, the present invention is accomplished to dissolve above mentioned problems of the related art and it is an object to provide a dot printing apparatus in which dot printing with high speed can be realized and printing quality can be remarkably improved by controlling secondary bounce of the printing wire occurring when the printing wire bounces from the stopper while dot printing. Especially, in the preferred embodiment, the present invention dissolves above problems by controlling characteristic of the secondary bounce which changes according to whether printing mode is the single dot printing mode or the continuous dot printing mode and according to the thickness of the print sheet.

To achieve the objects mentioned above, a dot printing apparatus of the present invention includes a print head performing dot printing on a print sheet by a printing wire and an actuator having a piezoelectric member connected to the printing wire for driving the printing wire, the dot printing apparatus comprising a supplying means for supplying electric energy to the piezoelectric member to charge thereof, a removing means for removing the electric energy from the charged piezoelectric member to discharge thereof, a judging means for judging whether dot printing data to be printed exists within a predetermined number of printing pitches on the print sheet next to a present printing pitch, a control means for controlling the removing means based on judgement by the judging means, so that the removing means removes a part of the electric energy from the charged piezoelectric member and thereafter completely removes remain of the electric energy therefrom.

According to the dot printing apparatus of the present invention, when a dot printing command is input to the apparatus from an external host computer, the electric energy is supplied to the piezoelectric member by the supplying means, whereby the printing wire of the print head is driven to the print sheet to perform the dot printing. After the electric energy is supplied to the piezoelectric member, the printing wire is returned from the print sheet in response to that the electric energy stored in the piezoelectric member is removed therefrom by the removing means. Here, at that time of removal operation, the judging means judges whether the dot printing data to be printed exists within the one or more printing pitches next to the present printing pitch. And if the judging means judges that the dot printing data exists within the one or more printing pitches next to the present printing pitch, the control means controls the removing means so that the removing means removes the part of the electric energy from the charged piezoelectric member. Thereafter, the removing means completely removes the remain of the electric energy therefrom.

In the dot printing apparatus of the present invention, if it is judged by the judging means that the dot printing data does not exist within the one or more printing pitches next to the present printing pitch, the control means controls the removing means so that the part of the electric energy stored in the charged piezoelectric member is removed therefrom and thereafter the remain of the electric energy is completely removed. Therefore, the secondary bounce of the printing wire caused when the printing wire returns to the fully retracted position can be effectively controlled. As a result, it can prevent the printing wire from tearing the print sheet and being broken because of excessive impact power occurring when the printing wire is returned. Further, it can be prevented that the printing wire performs double dot printing in the same printing pitch and sticks the printing ribbon.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification illustrating embodiments of the invention and, together with the description, serve to explain the objects, advantages and principles of the invention.

In the drawings.

DETAILED DESCRIPTION OF THE PREFERRED EMBODIMENTS

Figure 1:
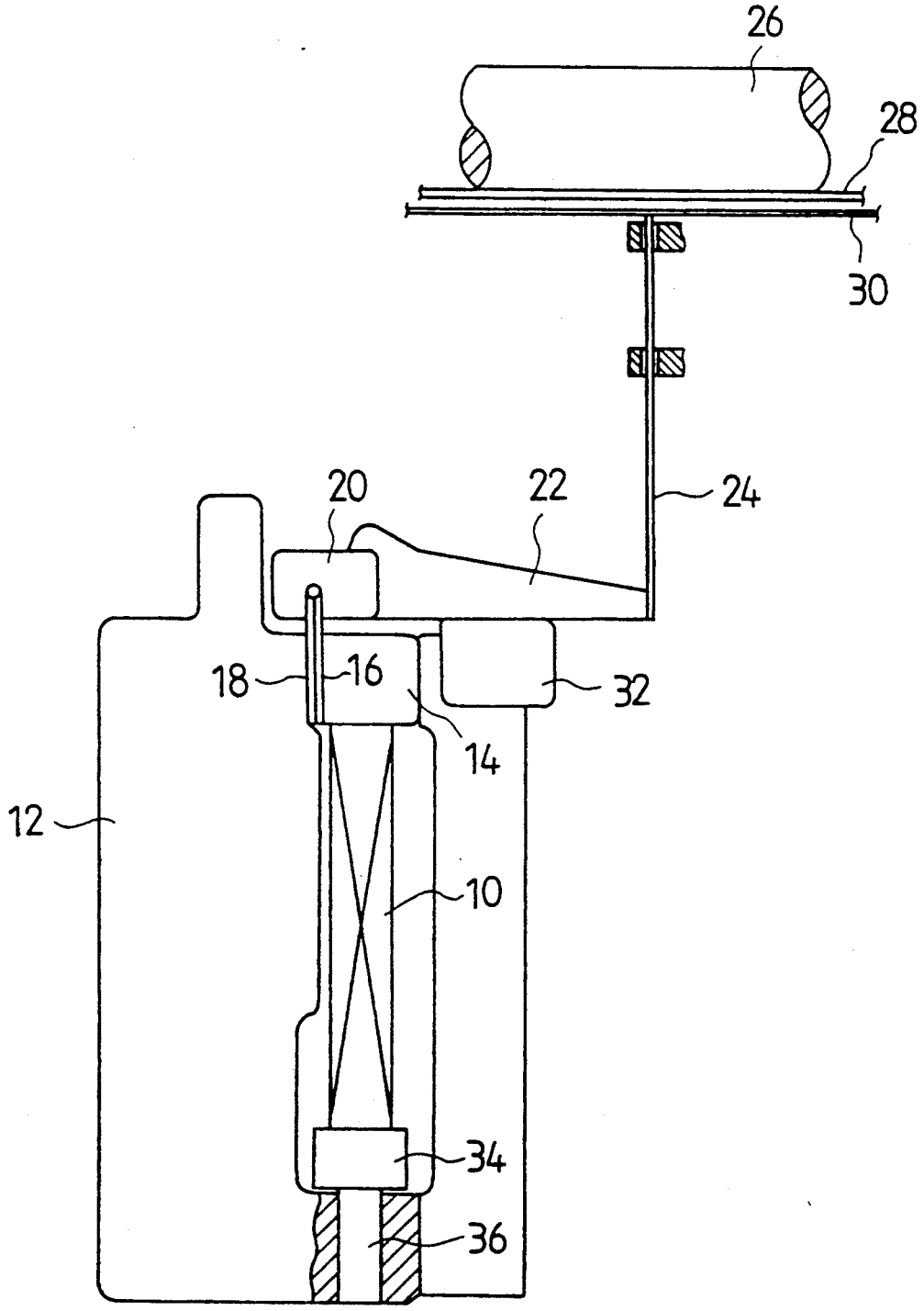
FIG. 1 is a schematic front view of an actuator having the piezoelectric member in the dot printing head installed in the dot printing apparatus of the first embodiment of the present invention.
Figure 2:
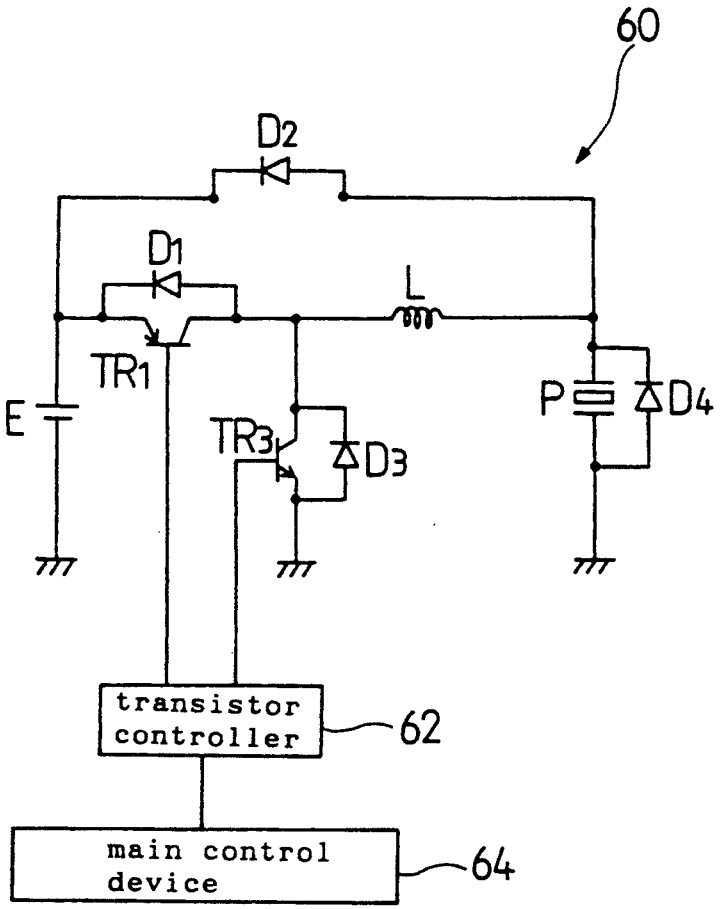
FIG. 2 is a diagram showing a driver circuit for the piezoelectric element utilized in the first embodiment of the present invention.

A detailed description of the first preferred embodiment of the dot printing apparatus will be given referring to the accompanying drawings. In FIG. 1, a piezoelectric print head is shown. In this print head, a plurality of piezoelectric actuators (first through m-th actuators) for activating a plurality of printing wires (first through m-th printing wires) are arranged therein. The printing wires are closely located in a line crossing with printing direction on a print sheet 28. Each of the piezoelectric actuators incorporates a multiple-layer piezoelectric member 10 which is operatively connected to the corresponding printing wire 24. The piezoelectric member 10 has a multiplicity of piezoelectric elements P (only one of which is indicated in FIG. 2, by way of example) which are superposed on each other in a direction (in the vertical direction against the sheet surface as seen in FIG. 1), so that the member 10 has a laminar structure. The piezoelectric member 10 is supported by a frame 12.

The piezoelectric member 10 has a movable member 14 sticked on an upper surface thereof. And at one side of the movable member 14, a sheet spring 16 is adhered, further, one more sheet spring 18 is sticked to the frame 12 in superposing on the sheet spring 16. A holder member 20 is attached to upper ends of both the sheet springs 16 and 18 and an arm 22 is extended horizontally from the holder member 20. At top of the arm 22, one end portion of the printing wire 24 is fixed so that the printing wire 24 extends in a vertical direction in FIG. 1. The other end portion (top portion) of the printing wire 24 is opposed to the print sheet 28 as a print medium supported on a platen 26, in existing a printing ribbon 30 between the top portion of the printing wire 24 and the print sheet 28.

According to above construction, when the piezoelectric member 10 is elongated in causing the sheet spring 16 to slidably move on the sheet spring 18 in the upward direction, the holder member 20 is pivoted in the counterclockwise direction as seen in FIG. 1, whereby the printing wire 24 is advanced toward the print sheet 28, to the fully advanced position. As a result, the top portion of the printing wire 24 is forced against the print sheet through the printing ribbon 30. Thus, an ink material of the ribbon 30 is transferred to a selected area of the print sheet 28, by impacting action of the printing wire 24, whereby a dot is formed on the selected area of the print sheet 28.

When the piezoelectric member 10 is contracted after the impacting action of the printing wire 24, the holder member 20 is pivoted in the clockwise direction, whereby the printing wire 24 is returned to its fully retracted position. This fully retracted position is determined by abutting contact of the arm 22 with a stopper 32 fixed to the frame 12. The stopper 32 is made of a rubber material having a relatively low degree of resiliency.

Here, as shown in FIG. 1, at the lower end of the piezoelectric member 10, a temperature compensating member 34 pressing the piezoelectric member 10 toward the movable member 14 by being pressurized through a pin 36 fixed to the frame 12, is secured. The piezoelectric member 10 has a residual strain in the forward direction even after the voltage is completely released therefrom. The amount of their residual strain decreases with an increase in the temperature. Consequently, the operating end (adjacent to the movable member 14) of the piezoelectric member 10 does not reach the normal operated position after the member 10 is displaced all the way upon energization thereof by the applied voltage, when the temperature is relatively high, even if the voltage applied to the member 10 is constant to assure a constant amount of displacement of the member 10. That is, the distance between the actual operated position of the piezoelectric member 10 and the nominal operated position increases as the temperature of the member 10 increases. To avoid or compensate for a fluctuation in the operated position of the piezoelectric member 10 due to a variation in the operating temperature, the temperature compensating member 34 is provided between the member 10 and the pin 36, such that the member 34 is connected in series with the member 10 in the longitudinal direction of the member 10. The member 34 expands as the temperature changes, so that the amount of elongation in the longitudinal direction of the member 10 increases with an increase in the temperature, Thus, the shortage in the distance of displacement of the operating end of the piezoelectric member 10 to the nominal operated position can be compensated for by the elongation of the temperature compensating member 34, so that the position of the operating end of the member 10 does not vary with a change in the operating temperature.

Next, a driver circuit for energizing the piezoelectric element P will be explained referring to FIG. 2. The piezoelectric member 10 arranged in each actuator mentioned above is energized by a driver circuit 60. Here, in the driver circuit 60, a plurality of the piezoelectric elements P constructing the piezoelectric member 10 are parallelly connected each other and one piezoelectric element P is representatively shown in FIG. 2.

In the driver circuit 60, a DC power source E, a transistor TR1, a coil L and the piezoelectric element P are mutually connected in series according to the order of the DC power source E, transistor TR1, the coil L and the piezoelectric element P. The transistor TR1 is connected with forward direction as same as a direction forwarding from a positive terminal of the DC power source E to a positive terminal of the piezoelectric element P. And a first diode D1 which by-passes the transistor TR1 toward reverse direction opposite to the forward direction is connected to the transistor TR1. Further, between the DC power source E and the piezoelectric element P, a second diode D2 is connected in parallel with the serial connection of the transistor TR1 and the coil L, in a direction forwarding from the piezoelectric element P to the DC power source E.

On the other hand, a terminal of the coil L which corresponds to the positive terminal of the DC power source E, is grounded through a transistor TR3. Forward direction of the transistor TR3 is as same as a direction from the coil L to earthing point. And a third diode D3 which by-passes the transistor TR3 in the reverse direction of the transistor TR3, is connected to the transistor TR3. Further, a fourth diode D4 which by-passes the piezoelectric element P, is connected to the piezoelectric element P. The fourth diode D4 is connected to the piezoelectric element P with forward direction as same as a direction from a negative terminal of the element P to a positive terminal thereof.

Each of the transistors TR1 and TR3 is controlled by a transistor controller 62. This transistor controller 62 is connected to each of plural driver circuits 60 (first through m-th circuit). These transistor controllers 62 with number of m are respectively connected to a common main control device 64. The main control device 64 selects the printing wire 24 to be utilized in printing among the printing wires 24 with number of m, every time the print head is moved along one printing pitch toward the printing direction, based on the printing data input from an external host computer, whereby the main control device 64 outputs printing command to each transistor controller 62 corresponding to the selected printing wire 24.

Figure 3:
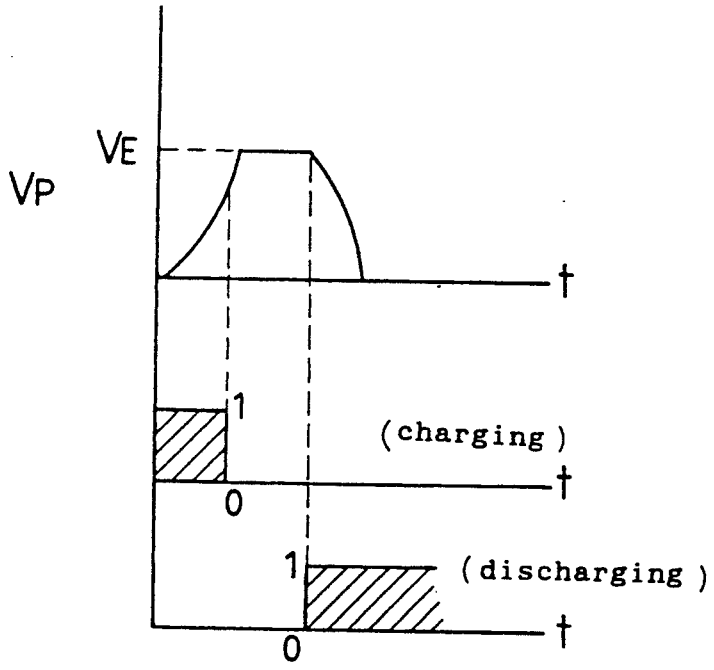
FIG. 3 is a graph illustrating a change in the voltage of the piezoelectric element while normal continuous dot printing mode.

Hereinafter, operation of the driver circuit 60 receiving control signal from the transistor controller 62 will be described. The transistors TR1 and TR3 are in the off-state in initial condition. Thereafter, the transistor controller 62 switches on the transistor TR1 and off the transistor TR3 according to the printing command from the main control device 64. As a result, electric charge from the DC power source E is transferred to the piezoelectric element P through the transistor TR1 and the coil L, whereby the piezoelectric element P is charged, thus, the voltage $V_P$ of the piezoelectric element P rises as shown in FIG. 3. According to this rising of the voltage $V_P$, the printing wire 24 is advanced to the print sheet 28 from the fully retracted position.

The top end of the printing wire 24 is pressed to the print sheet 28 in a little before the voltage $V_P$ of the piezoelectric element P becomes same value as the voltage of the DC power source E (abbreviated $V_E$ hereinafter). After the voltage $V_P$ becomes the same value of the voltage $V_E$, the current from the coil L to the piezoelectric element P is circulated to the coil L through the second diode D2 and the transistor TR1 since the electric potential in the second diode D2 at the side for the piezoelectric element P becomes higher than that at the side for the DC power source E, whereby the electric energy is stored in the coil L. This excessive electric energy is not stored in the piezoelectric element P, therefore, the voltage $V_P$ of the piezoelectric element P does not exceed the voltage $V_E$. In this state, the electric energy stored in the piezoelectric element P is consumed by pressing the printing wire 24 to the print sheet 28. If the voltage $V_P$ of the piezoelectric element P decreases, the electric charge from the DC power source E is transferred to the piezoelectric element P through the transistor TR1 and the coil L,. as a result, the voltage $V_P$ is maintained to the same value as the voltage $V_E$ to compensate for the decreased voltage.

The transistor controller 62 switches off the transistor TR1 after a predetermined time interval in that the voltage $V_P$ of the piezoelectric element P continues to maintain the same value of the voltage $V_E$. As a result, a closed circuit including the coil L, the second diode D2, the D.C. power source E and the third diode D3 is formed, whereby the electric energy stored in the coil L becomes the 0 (zero) since the electric energy of the coil L is circulated to the D.C. power source E. And discharging of the piezoelectric element P is commenced at a time when a predetermined time interval is passed since the dot printing command is input. Here, that time reaches at the same time when the electric energy stored in the coil L is completely circulated to the D.C. power source E or at a time after such circulation of the electric energy is completed.

Next, discharging manner of the piezoelectric element P will be described hereinafter. At first, the discharging in case of the normal continuous dot printing mode, that is, in case while performing of the continuous dot printing, will be explained. In that case, the transistor controller 62 switches on the transistor TR3, whereby a closed circuit including the piezoelectric element p, the coil L and the transistor TR3 is formed. Consequently, the electric energy of the piezoelectric element P is transferred to the coil L and the element P is discharged. At this time, as shown in FIG. 3, the voltage of the piezoelectric element P decreases to 0 (zero) after discharging time which is determined according to both equivalent capacitance of the piezoelectric element P and reactance of the coil L. In proportion to discharging of the piezoelectric element P, the printing wire 24 is retracted from the print sheet 28 and returned to the fully retracted position. At the time when the printing wire 24 is fully retracted, the arm 22 is contacted to the stopper 32 with relatively strong impact power, therefore, the printing wire 24 remarkably bounces from the stopper 32 due to such contact of the printing wire 24 and the stopper 32. However, in this case, such remarkable bounce of the printing wire 24 is effectively used for next dot printing since the dot printing is conducted by the printing wire 24 in next printing pitch continuous to the present printing pitch, thus, the printing wire 24 never performs unnecessary dot printing based on such bounce.

Here, the transistor controller 62 continuously scans the value of the voltage $V_P$ in the piezoelectric element P so as to detect a time when such value of the voltage $V_P$ becomes 0 (zero), that is, when the electric energy of the piezoelectric element P is completely transferred to the coil L, whereby the transistor controller 62 switches off the transistor TR3 after detecting the time. As a result, a closed circuit including the coil L, the first diode D1, the D.C. power source E and the fourth diode D4 is formed, therefore, the electric energy stored in the coil L is circulated to the D.C. power source E. Here, the fourth diode D4 prevents the electric energy of the coil L from being accumulated in the piezoelectric element P.

Figure 4:
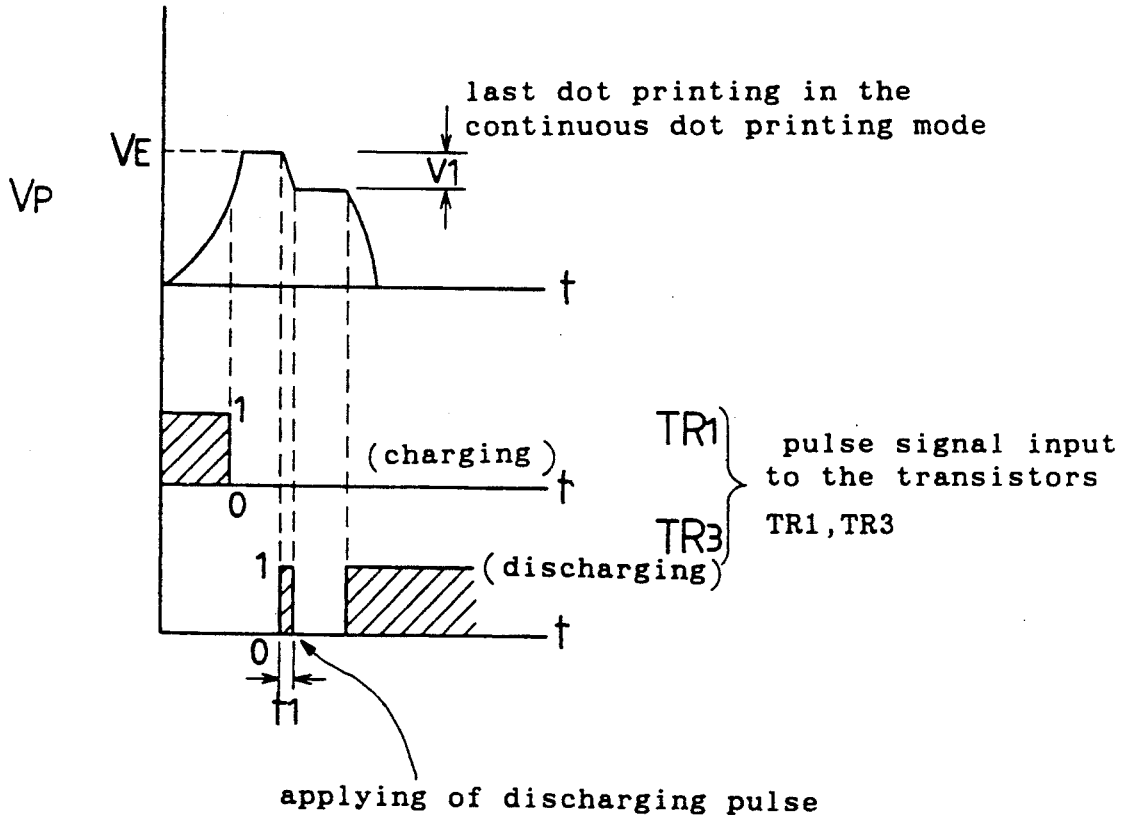
FIG. 4 is a graph illustrating a change in the voltage of the piezoelectric element when the last dot is printed in the continuous dot printing mode.
Figure 5:
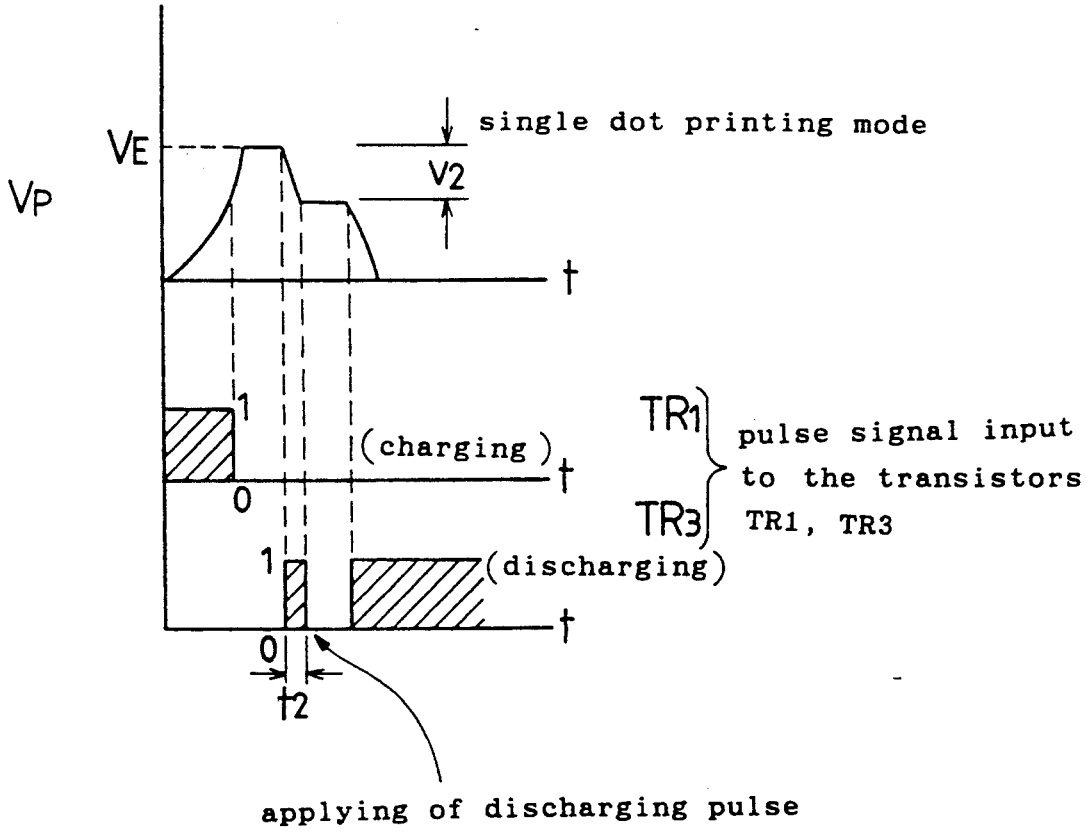
FIG. 5 is a graph illustrating a change in the voltage of the piezoelectric element while the single dot printing mode.

Further, charging and discharging manners in case that the last dot is formed in the continuous dot printing mode (last dot printing mode) will be described hereinafter. In this case, the transistor controller 62 switches on the transistor TR1 and off the transistor TR3 at the same time, and after 80 μ(micro)seconds, it switches on the transistor TR3 for 7 μseconds, thereafter, switches off the transistor TR3. By this control, the electric energy of the piezoelectric element P is maintained to constant value after the energy is decreased according to a discharging pulse with time length t1 as shown in FIG. 4. Further, the remained electric energy of the piezoelectric element P is quickly discharged after 100 μseconds, based on discharging command input from the main control device 64.

Following, charging and discharging manners in case of the single dot printing mode will be described hereinafter. In this case, the transistor controller 62 switches off the transistor TR3 and on the transistor TR1 at the same time, and after 130 μseconds, it switches on the transistor TR3 for 13 μseconds. The reason why such control of the transistor TR1, TR3 is conducted is that movement energy of the printing wire 24 is lower in the single dot printing than in the continuous dot printing. In this case, similarly to above case shown in FIG. 4, the electric energy in the piezoelectric element P is maintained to constant value after partial removal therefrom. At that time, the time length t2 while the discharging pulse is input to the transistor TR3 is set longer than that in the case of the last dot printing mode as shown in FIG. 4 (see FIG. 6). And the remained electric energy in the piezoelectric element P is quickly discharged after 100 μseconds, based on the discharging command input from the main control device 64.

As mentioned above, the time length t2 in the single dot printing mode while the transistor TR3 is switched on according to the discharging command, is set longer than that (t1) in the last dot printing mode ($t2>t1$), since the returning speed of the printing wire 24 in the single dot printing mode is slower than that in the last dot printing mode, therefore, the bouncing strength occurring when the arm 22 is contacted to the stopper 32 is different from each other in both cases of the single dot printing and the last dot printing if the same control condition is applied to both modes. As a result, the height of the voltage $V_1$ discharged from the piezoelectric element P in the single dot printing mode becomes less than that ($V_2$) in the last dot printing mode ($V_1<V_2$). And after retaining these conditions to delay the discharging for 100 μseconds, the transistor TR3 is switched on again, whereby the electric energy in the piezoelectric element P is quickly discharged similarly to the case of the normal continuous dot printing.

Figure 7A:
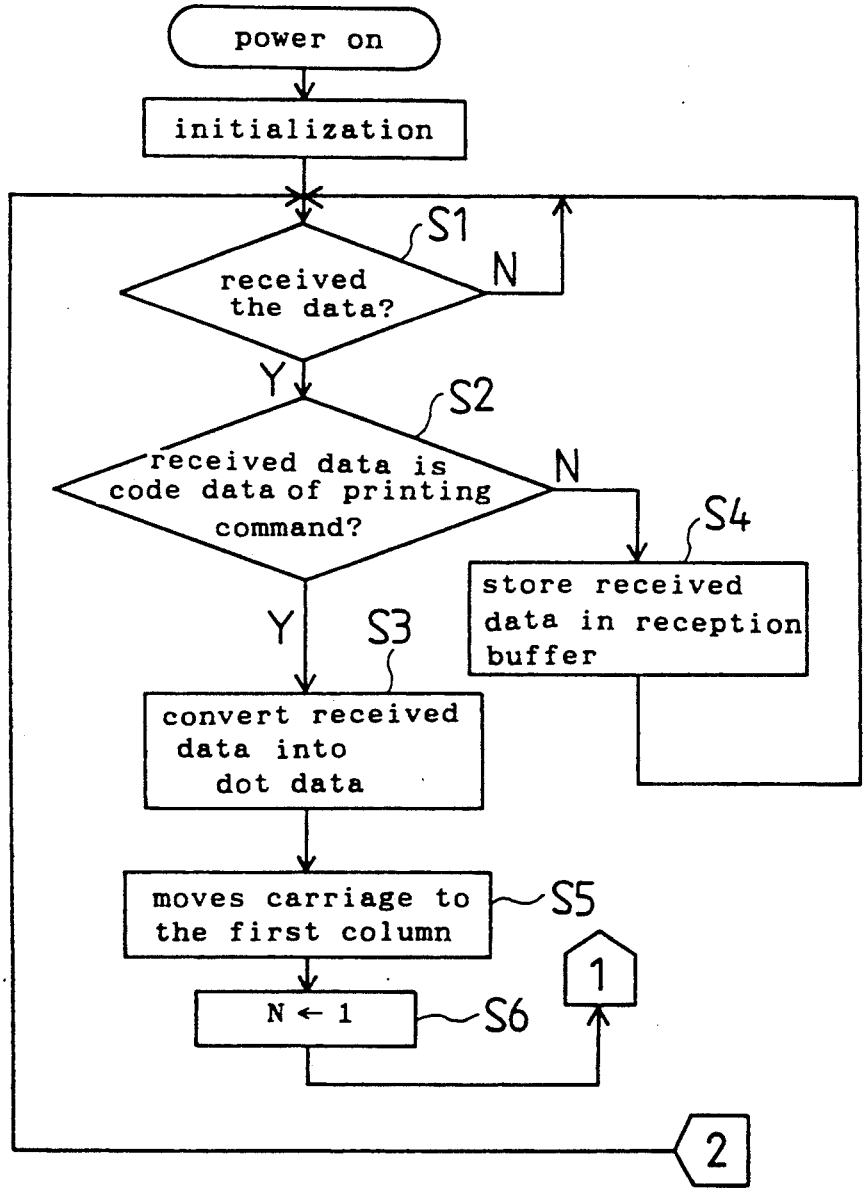
Figure 7B:
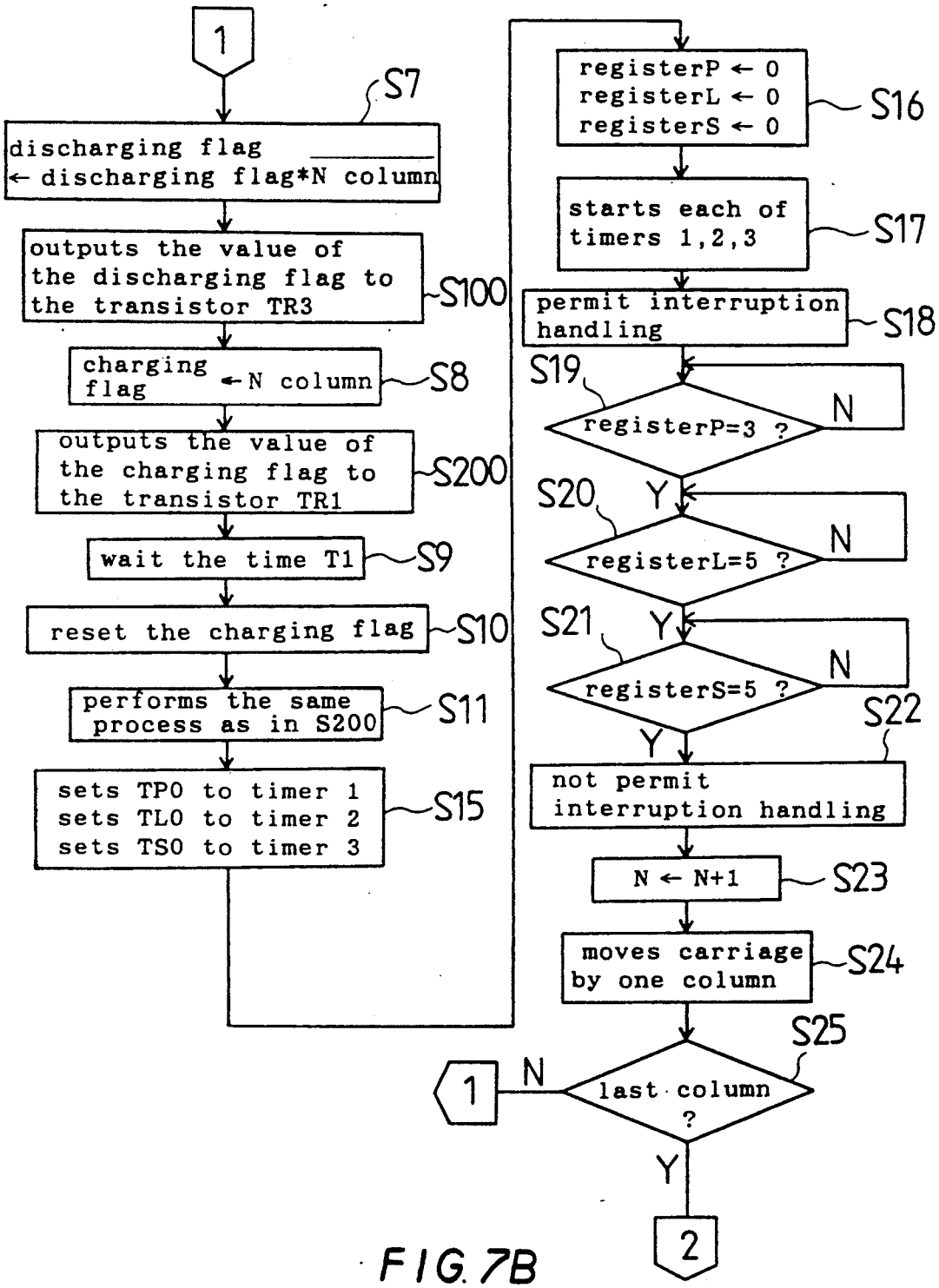

Next, control process for charging and discharging of the piezoelectric element P will be described hereinafter, referring to flow charts shown in FIGS. 7(*a*), 7(*b*) and block diagrm of FIG. 12. Initially, electric power is turned on and initialization of the program is done. After this, it is judged in step (abbreviated as "S" hereinafter) 1 whether the data is received from the external host computer. If judged "YES", the process shifts to S2, and if judged "NO", the process is waited till the data is received. Further, in S2, it is judged whether the received data is a code data of the printing command. If judged "YES" in S2, the data stored in a reception buffer at that time is converted into image data (dot data) and stored in an image buffer (S3). On the other hand, in case that it is judged "NO" in S2, the received data is stored in the reception buffer in S4, and the process is returned to S1 to wait the data from the external host computer. After the received data is converted into the dot data in S3, a carriage on which the print head is mounted is moved to the first column (the first printing pitch) in S5, and further, the count number N in a column counter is initialized in 1 in S6. Clearly understood from above, according to processes through S1–S6, the carriage is moved to the N-th column before long. Thus, the dot printing manner in the N-th column will be described hereinafter.

Figure 12:
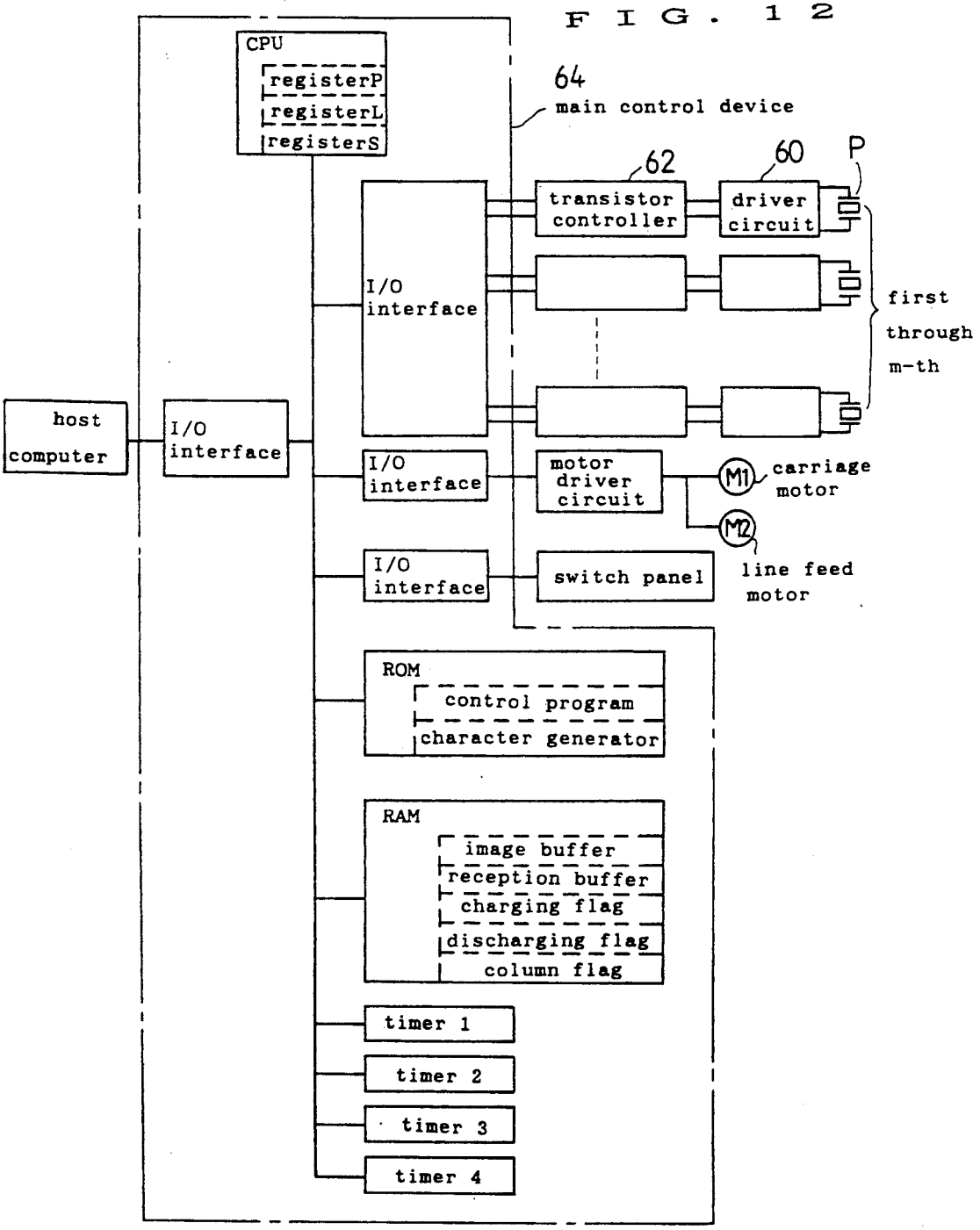
FIG. 12 is a block diagram of the first embodiment to control the cahrging and the discharging of the piezoelectric element according to the flow charts shown in FIGS. 7(*a*), (*b*), 8, 9 and 10.

Here, as shown in FIG. 12, a column flag comprising three bits memory, each bit corresponding to the "N−1" column, the N column and the "N+1" column, is arranged in the main control device 64. And the number of the column flag is as same as the numer of the printing wire 24, that is, the column flag number is "m". In the column flag, the value "1" is set in each bit if the dot printing data exists in the corresponding column thereto, on the other hand, the value "0" is set in each bit if the dot printing data does not exist in the corresponding column thereto. That is to say, in the middle dot printing mode, the value "1" is set in all bits corresponding to the "N−1" column, the N column and the "N+1" column, respectively. And in the last dot printing mode, the value "1" is set in the two bits corresponding to both the "N−1" column and the N column, contrarily, the value "0" is set in the bit corresponding to the "N+1" column. Further, in the single dot printing mode, the value "0" is set in the two bits corresponding to both the "N−1" column and the "N+1" column, contrarily, the value "1" is set in the bit corresponding to the N column.

Figure 6:
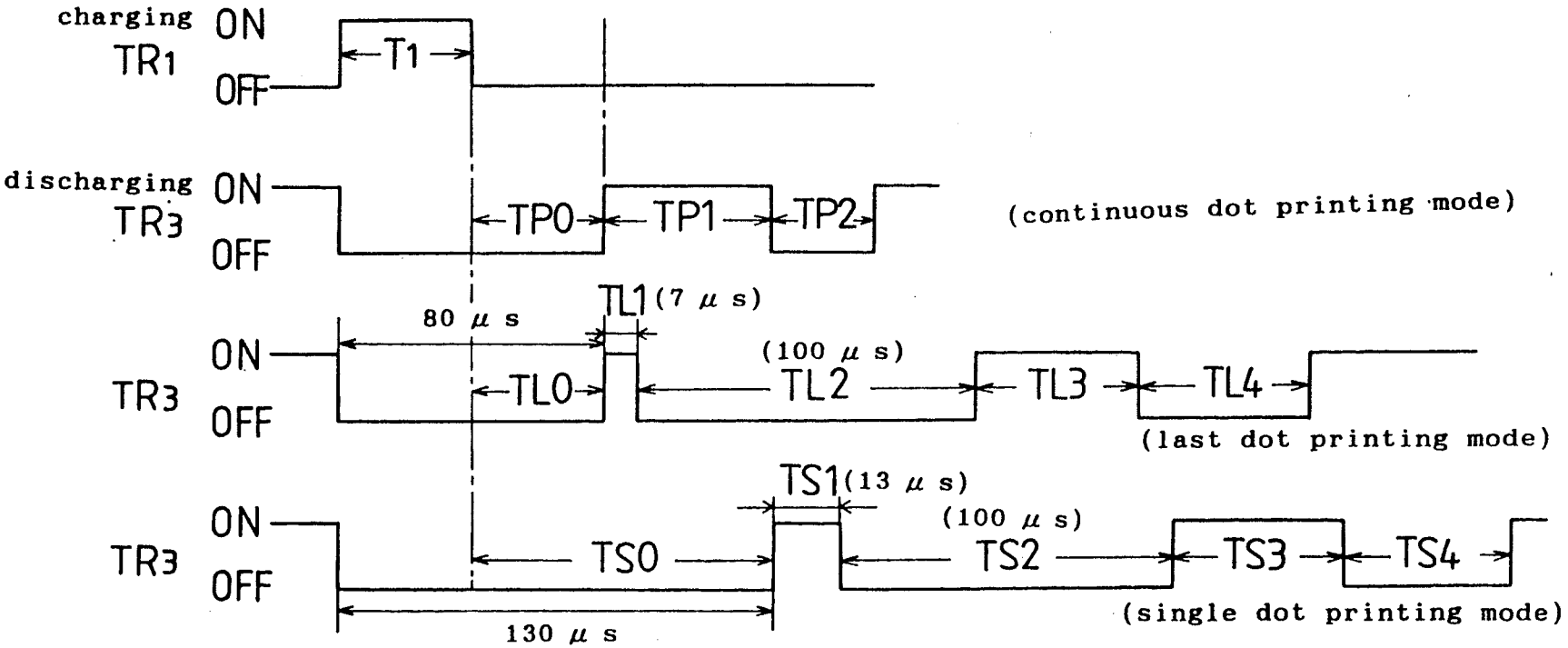
FIG. 6 is a timing charts while the piezoelectric element is charged and discharged in the normal continuous dot printing mode, last dot printing in the continuous dot printing mode and the single dot printing mode, FIG. 7(*a*) and (*b*) are flow charts to execute charging and discharging of the piezoelectric element according to the timing charts shown in FIG. 6.

In case that the data to be printed in the N-th column exists (in this case, "1" is set to the column flag), "AND" value of the "NOT" value in the N-th column (in this case, the "NOT" value is "0") and the value in a discharging flag (in this case, "1" is set to the discharging flag) is obtained in S7, as a result, the discharging flag is set to "0". And the value "0" in the discharging flag is input to the base of the transistor TR3 (S100), therefore, the transistor TR3 is switched off. In S8, the value "1" is set to a charging flag, thus, the value set in the charging flag is input to the base of the transistor TR1 in S200. Accordingly, the transistor TR1 is switched on and the on-state of the transistor TR1 is continued for a time T1 in S9. Here, the time T1 is a time for which the transistor TR1 is maintained in its on-state as shown in FIG. 6. Here, the time T1 is clocked by a timer 4 shown in FIG. 12. The electric energy from the D.C. power source E is supplied to the piezoelectric element P through the transistor TR1 and the coil L for the time T1, whereby the piezoelectric element P is charged. Consequently, the dot printing by the printing wire 24 is performed on the print sheet 28.

After the time T1 is elapsed, the charging flag is reset to the value "0" in S10, and the value "0" in the charging flag is input to the transistor TR1, similarly to S200, whereby the transistor TR1 is switched off in S11.

In S15, three timers comprising of timer 1 corresponding to the dot printing in the middle of the continuous dot printing mode (middle dot printing mode), timer 2 corresponding to the dot printing of the last dot in the continuous dot printing mode (last dot printing mode) and timer 3 corresponding to the single dot printing mode, are set respectively. Here, the time TP0 is set to the timer 1, the time TL0 is set to the timer 2 and the time TS0 is set to the timer 3 as shown in S15. Thereafter, a timer register P, a timer register L and a timer register S, each corresponding respectively to the timer 1, the timer 2 and the timer 3, are initialized to the value "0", as a result, each timer 1, 2 and 3 is started in S17.

And interruption handling (mentioned hereinafter) by each of the timers is made permissible in S18, and further the interruption handling by each timer is performed when each timer 1, 2 and 3 is timed up. Next, it is judged whether each value of the timer register P, L and S is 3, 5 and 5, respectively (S19–S21). If judged "YES" in all steps S19, S20 and S21, the interruption handling is made impermissible in S22 and the column number N is incremented to "N+1" in S23, whereby the carriage is moved to one column according to the printing direction in S24. Thereafter, it is judged whether the present column is the last column in S25. If judged the last column, the process is returned to S1 in order to perform the dot printing of the first column in the next line. On the other hand, if judged not the last column, the process is returned to S7 in order to perform the dot printing of the next column.

Here, above permission state of the interruption handling by the timers 1, 2 and 3 is maintained till the value in each register P, L and S becomed 3, 5 and 5, respectively. And during this permission state, the interruption handling mentioned hereinafter is performed every time each of the timers 1, 2 and 3 terminates to clock.

Figure 8:
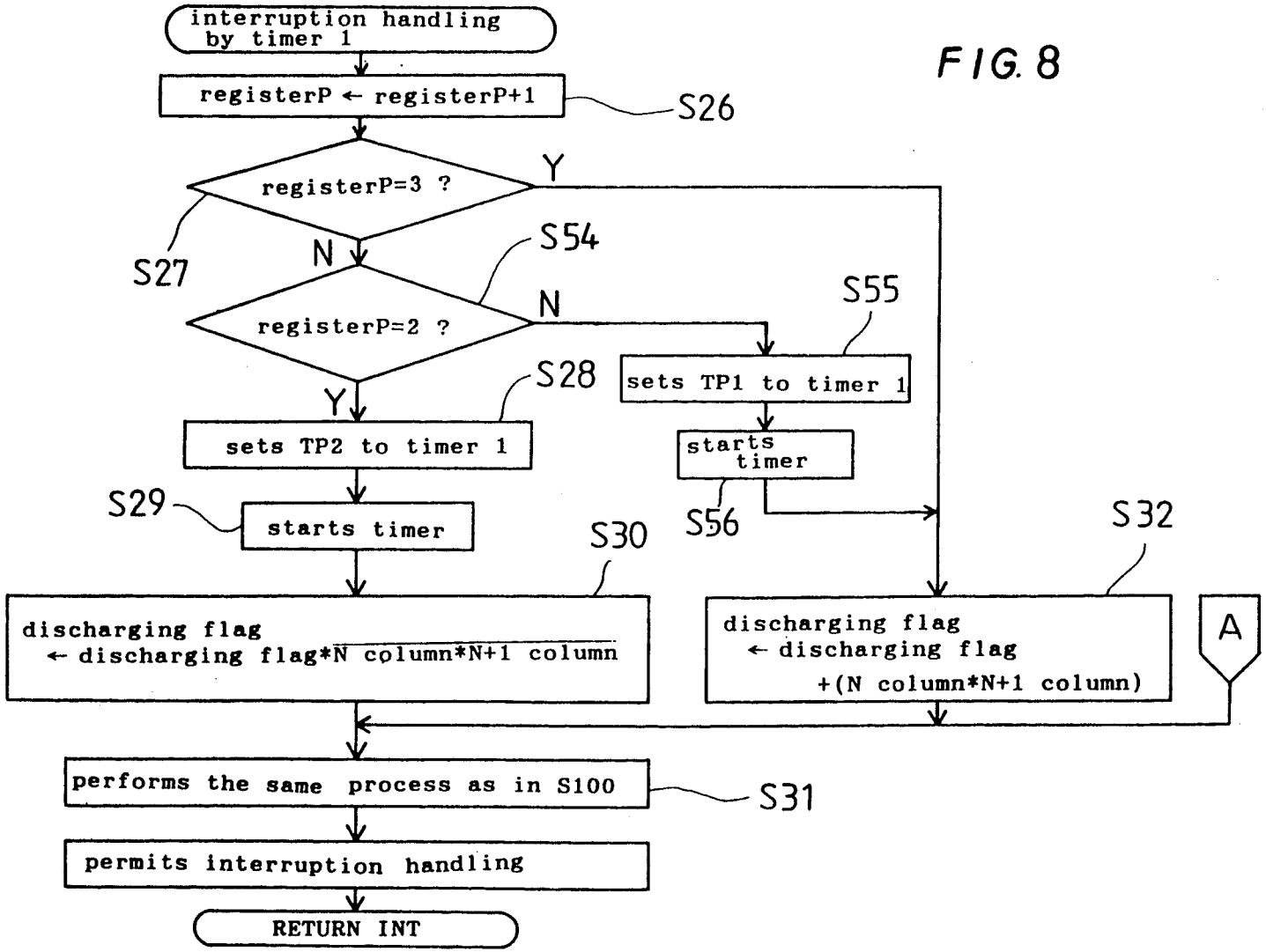
FIG. 8 is a flow chart of an interrupt handling routine by a timer 1.

Next, the interruption handling by the timer 1, the timer 2 and the timer 3 will be described, respectively. At first, the interruption handling by the timer 1 is explained according to FIG. 8. In case that the time TP0 set in the timer 1 is timed up, the timer register P is incremented to "P+1" in S26, thereafter, it is judged whether the value in the timer register P is 3 in S27. If judged that the value of the timer register P is not 3 (in this case, the value is 1 or 2), in the next S54, it is judged whether the value of the timer 1 is 2. And if judged not 2 in S54, the time TP1 shown in FIG. 6 is set to the timer 1 in S55, thereafter, the timer 1 is started to clock in S56. Further, it is judged that the value in the discharging flag is "1" in S32. Here, while in the middle dot printing mode, in S32, since the discharging flag value is "0" and the "AND" value of the N column and the "N+1" column is "1", the "OR" value obtained from the discharging flag value and the "AND" value becomes "1", whereby the discharging flag is set to "1". Thereafter, the value "1" of the discharging flag is input to the base of the transistor TR3 for the time TP1 in S31, similaly to S100, therefore, the piezoelectric element P only corresponding to the printing wire 24 in the middle dot printing mode is completely discharged for the time TP1. Here, the value of the discharging flag does not vary in S32 while in both the last dot printing mode and the single dot printing mode.

On the contrary, if it is judged that the value of the timer register P is 2, the time TP2 shown in FIG. 6 is set to the timer 1 in S28 and the timer is started to clock in S29. Further, it is judged that the value in the discharging flag is "0" in S30. Here, while in the middle dot printing mode, in S30, the values of the N column and the "N+1" column are "1" since the dot data exists in both columns, therefore, the "NOT" value obtained by reversing the "AND" value of the N column and the "N+1" column is "0". And the value in the discharging flag is "1". Accordingly, the "AND" value of the above "NOT" value and the discharging flag value becomes "0", whereby the value "0" is set to the discharging flag at this time. Following S30, the value "0" is input to the base of the transistor TR3 in S31, similarly to S100, as a result, the piezoelectric element P is prevented from discharging for the time TP2 since the transistor TR3 is switched off. Here, the value of the discharging flag does not vary in S30 while in both the last dot printing mode and the single dot printing mode.

Further, if it is judged that the value of the timer register P is 3 in S27, the discharging flag is set to "1" in S32. Here, as mentioned above, the same process is conducted in S32, whereby the discharging flag is set to "1". Thereafter, the value "1" of the discharging flag is input to the base of the transistor TR3, therefore, the piezoelectric element P is discharged. In this case, though the printing wire 24 is strongly bounced from the stopper 32, there is no problem in this middle dot printing mode since the dot printing is performed in the next "N+1" column.

Figure 9:
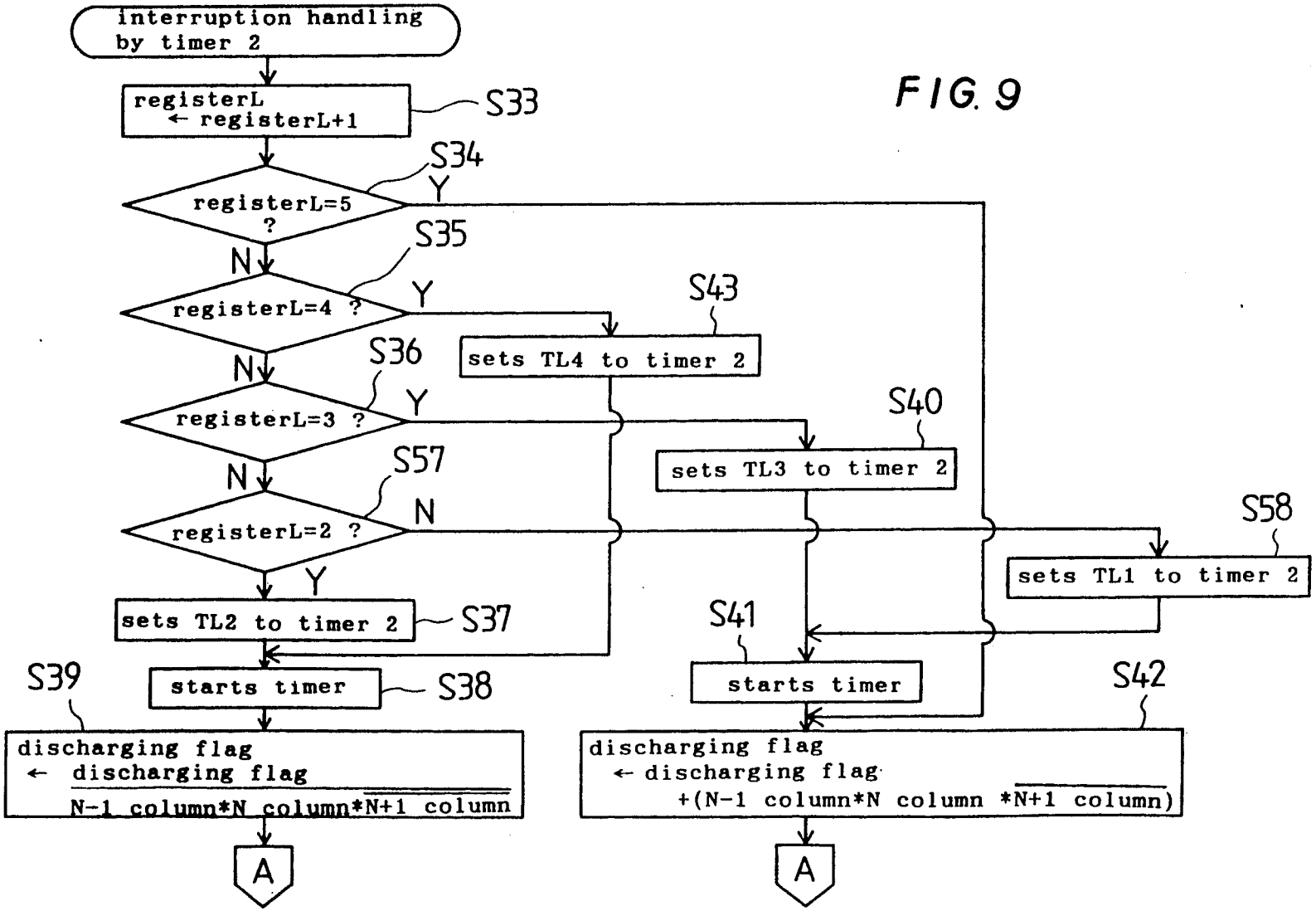
FIG. 9 is a flow chart of an interrupt handling routine by a timer 2.

Next, the interruption handling by the timer 2 will be described according to FIG. 9. In case that the time TL0 set in the timer 2 is timed up, the timer register L is incremented to "L+1" in S33, thereafter, it is judged whether the value of the timer register L is 3, 4, 5 or 2 through S34, S35, S36 and S57. If the value of the timer register L does not coincide all of 3, 4, 5 and 2 (that is, in this case, the value is 1), the time TL1 is set to the timer 2 in S58, thereafter, the timer 2 is started to clock in S41. And in S42, it is judged that the discharging flag value is "1". Here, while in the last dot printing mode, in S42, the values of the "N−1" column and the N column are "1" since the dot data exists in both columns, and the "NOT" value of the "N+1" column is "1" since the dot data does not exist in the "N+1" column, thus, the value of the "N+1" is "0". Accordingly, the "AND" value obtained from the "N−1" column, the N column and the "NOT" value of the "N+1" column, is "1". And the value of the discharging flag is set to "1". Clearly from above, the "OR" value of the discharging flag value "1" and such "AND" value "1" becomes "1". Following S42, the value "1" is input to the base of the transistor TR3 for the time TL1 in S31, similarly to S100, as a result, the piezoelectric element P corresponding to the printing wire 24 in the last dot printing mode is partially discharged for the time TL1 since the transistor TR3 is switched on. Here, the value of the discharging flag does not vary in S42 while in both the middle dot printing mode and the single dot printing mode.

Contrarily, if it is judged that the value of the timer register L is 2 in S57, the time TL2 shown in FIG. 6 is set to the timer 2 in S37, thereafter, the timer 2 is started to clock in S38. And in S39, it is judged that the value of the discharging flag is "0". Here, whilein the last dot printing mode, in S39, the values of the "N−1" column and the N column are "1" since the dot data exists in both columns, and the "NOT" value of the "N+1" column is "1" since the dot data does not exist in the "N+1" column, thus, the value of the "N+1" is "0". Accordingly, the "NOT" value obtained from the "AND" value of the "N−1" column, the N column and the "NOT" value of the "N+1" column, is "0". And the value of the discharging flag is set to "1". Clearly from above, the "AND" value of the discharging flag value "1" and such "NOT" value "0" becomes "0". Following S39, the value "0" is input to the base of the transistor TR3 for the time TL2 in S31, similarly to S100, as a result, the piezoelectric element P is prevented from discharging for the time TL2 since the transistor TR3 is switched off. Here, the value of the discharging flag does not vary while in both the middle dot printing mode and the single dot printing mode. Consequently, bouncing force of the printing wire 24 is weakened, whereby unnecessary dot printing in the next "N+1" column is prevented effectively.

On the other hand, if it is judged that the value of the timer register L is 3 in S36, the time TL3 shown in FIG. 6 is set to the timer 2 in S40, thereafter, the timer 2 is started to clock in S41. Further, in S42, it is judged that the discharging flag value is "1". Here, as mentioned above, the same process is conducted in S42. Therefore, next to S42, the value "1" is input to the base of the transistor TR3 in S31, similarly to S100, as a result, the piezoelectric element P is completely discharged for the time TL3 since the transistor TR3 is switched on.

Further, if it is judged that the value of the timer register L is 4 in S35, the time TL4 shown in FIG. 6 is set to the timer 2 in S43, thus, the timer 2 is started to clock in S38. In this case, since it is judged that the discharging flag value is "0" in S39 as mentioned above, the transistor TR3 is switched off in S31, therefore, the piezoelectric element P is prevented from discharging for the time TL4. And if it is judged that the value of the timer register L is 5 in S34, the value "1" is set to the discharging flag in S42, whereby the transistor TR3 is switched on and the piezoelectric element P is discharged.

Figure 10:
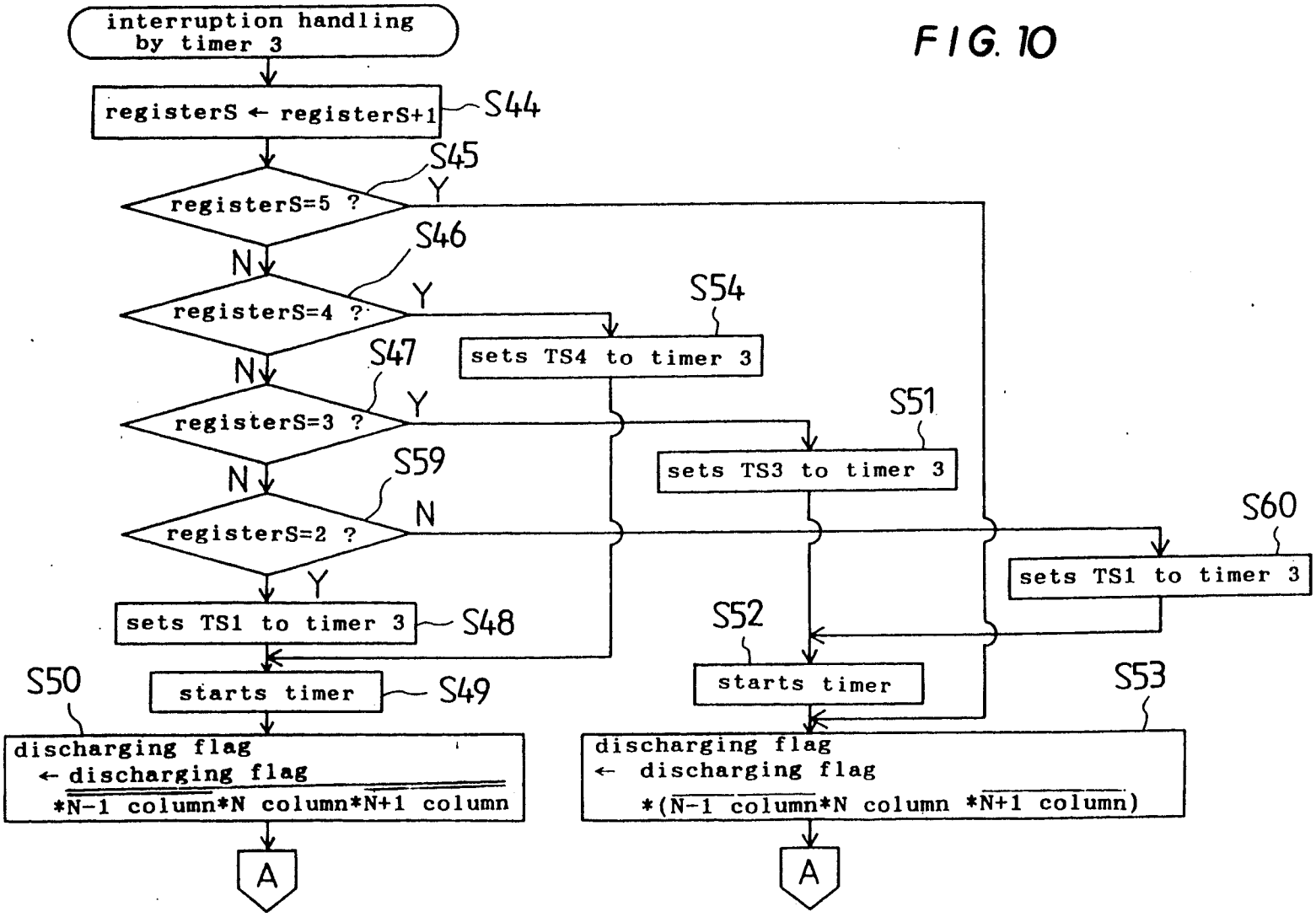
FIG. 10 is a flow chart of an interrupt handling routine by a timer 3.

Next, the interruption handling by the timer 3 will be described according to FIG. 10. In case that the time TS0 set to the timer 3 is timed up, the timer register S is incremented to "S+1" in S44, thereafter, it is judged whether the value of the timer register L is 3, 4, 5 or 2 through S45, S46 S47 and S59. If the value of the timer register L does not coincide all of 3, 4, 5 and 2 (that is, in this case, the value is 1), the time TS1 is set to the timer 3 in S60, thereafter, the timer 3 is started to clock in S52. Further, in S53, it is judged that the discharging flag value is "1". Here, while in the single dot printing mode, in S53, the value of the "N−1" column is "0" since the dot data does not exist therein, so the "NOT" value of the "N−1" column is "1". And the value of the N column is "1" since the dot data exists therein. Further, the "NOT" value of the "N+1" column is "1" since the dot data does not exist in the "N+1" column. Accordingly, the "AND" value obtained from the "NOT" value of the "N−1" column, the N column and the "NOT" value of the "N+1" column, is "1". And the value of the discharging flag is set to "1". Clearly from above, the "AND" value of the discharging flag value "1" and such "AND" value "1" becomes "1". Following S53, the value "1" is input to the base of the transistor TR3 for the time TS1 in S31, similarly to S100, as a result, the piezoelectric element P only corresponding to the printing wire 24 in the single dot printing mode is partially discharged for the time TS1 since the transistor TR3 is switched on. Here, the value of the discharging flag does not vary in S53 while in both the middle dot printing mode and the last dot printing mode.

On the contrary, if it is judged that the value of the timer register S is 2, the time TS2 shown in FIG. 6 is set to the timer 3 in S48, thereafter, the timer 3 is started to clock in S49. And in S50, it is judged that the value of the discharging flag is "0". Here, while in the single dot printing mode, in S50, the value of the "N−1" column is "0" since the dot data does not exist therein, so the "NOT" value of the "N−1" column is "1". And the value of the N column is "1" since the dot data exists therein. Further, the "NOT" value of the "N+1" column is "1" since the dot data does not exist in the "N+1" column. Accordingly, the "NOT" value obtained from the "AND" value comprising of the "NOT" value of the "N−1" column, the N column and the "NOT" value of the "N+1" column, is "0". And the value of the discharging flag is set to "1". Clearly from above, the "AND" value of the discharging flag value "1" and such "NOT" value "0" becomes "0". Following S50, the value "0" is input to the base of the transistor TR3 for the time TS2 in S31, similarly to S100, as a result, the piezoelectric element P is prevented from discharging for the time TS2 since the transistor TR3 is switched off. Here, the value of the discharging flag does not vary in S50 while in both the middle dot printing mode and the last dot printing mode. Consequently, bouncing force of the printing wire 24 is weakened, whereby unnecessary dot printing in the next "N+1" column is prevented effectively.

On the other hand, if it is judged that the value of the timer register S is 3 in S47, the time TS3 shown in FIG. 6 is set to the timer 2 in S51, thereafter, the timer 3 is started to clock in S52. Further, in S53, it is judged that the discharging flag value is "1". Here, as mentioned above, the same process is conducted in S53. Accordingly, next to S53, the value "1" is input to the base of the transistor TR3 in S31, similarly to S100, as a result, the piezoelectric element P is completely discharged for the time TS3 since the transistor TR3 is switched on.

Further, if it is judged that the value of the timer register S is 4 in S46, the time TS4 shown in FIG. 6 is set to the timer 3 in S54, thus, the timer 3 is started to clock in S49. In this case, since it is judged that the discharging flag value is "0" in S50 as mentioned above, the transistor TR3 is switched off in S31, therefore, the piezoelectric element P is prevented from discharging for the time TS4. And if it is judged that the value of the timer register S is 5 in S45, the value "1" is set to the discharging flag in S53 as mentioned above, whereby the transistor TR3 is switched on and the piezoelectric element P is discharged.

Here, among the time TP1, the time TL1 and the time TS1 which are already mentioned above, there is a relation of TP1>TS1>TL1 as shown in FIG. 6. The reason why each times of TP1, TS1 and TL1 are mutually related under such relation is that (1) it is necessary to fast discharge the piezoelectric element P in the middle dot printing mode since the next dot printing continues therein, (2) it is necessary to discharge the piezoelectric element P slowly in the last dot printing mode to lower the bouncing force of the printing wire 24 since the next dot does not have to be printed and (3) the piezoelectric element P can be discharged in the single dot printing mode a little bit slowly than in the last dot printing mode since the returning speed of the printing wire 24 in the single dot printing mode is slower than that in the last dot printing mode.

As mentioned above, in both cases of the single dot printing mode and the last dot printing mode, the bounce characteristic of the printing wire 24 after rebounced from the stopper 32 is effectively controlled by controlling the on- and off-state of the transistor TR3 based on discharging command from the transistor controller 62. That is to say, in the dot printing apparatus of this embodiment, it is judged whether the dot printing is already performed in one past printing pitch or in past predetermined printing pitches in case that it is unnecessary to perform dot printing in one printing pitch or in predetermined printing pitches next to the present printing position. And the bounce characteristic of the printing wire 24 is controlled by changing width and timing of the discharging control pulse since the bounce characteristic of printing wire 24 is different depending on whether the dot printing is performed in the past one or predetermined printing pitches.

The invention is not limited to the above embodiment though explanation is done in both the single dot printing mode and the last dot printing mode.

As mentioned above, in the dot printing apparatus of the first embodiment, it is judged whether the dot printing mode is the continuous dot printing mode or the last dot printing mode or the single dot printing mode. And the applying timing and the pulse width of the discharging pulse are controlled according to the judged dot printing mode. As a result, the stable operation of the printing wire 24 can be realized after the dot printing in both the last dot printing mode and the single dot printing mode. Therefore, the omission of the dots and the sticking of the printing ribbon 30 by the printing wire 24 does not occur, thus, the quality of the printing and the printing speed can be remarkably improved.

Figure 11:
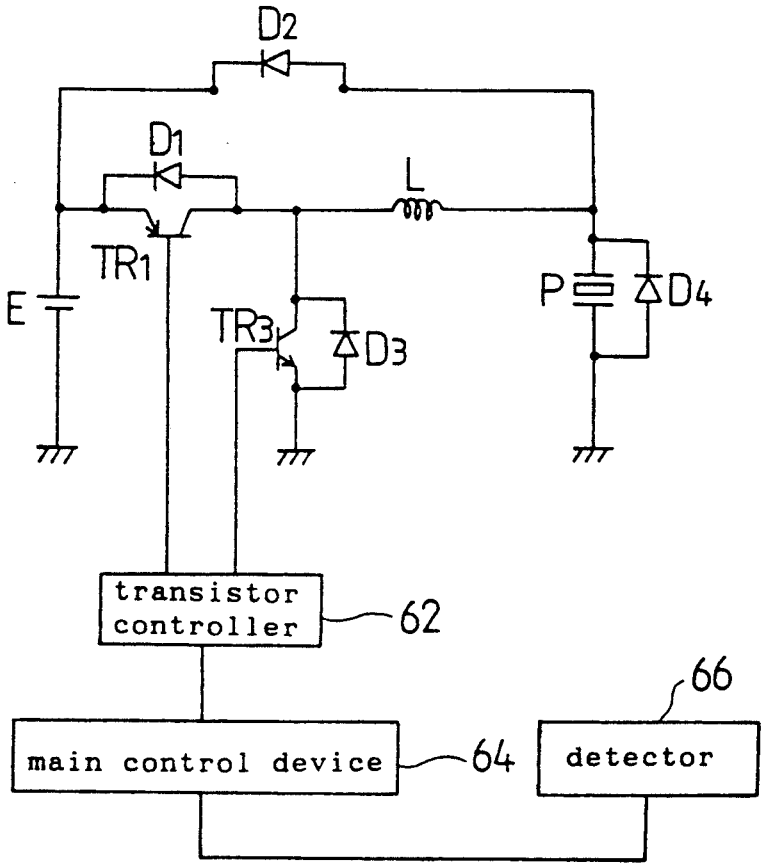
FIG. 11 is a diagram showing a driver circuit for the piezoelectric element utilized in the second embodiment of the present invention.

On the other hand, it is already mentioned above that the secondary bounce characteristic of the printing wire 24 depends on the thickness of the print sheet 28. To control the secondary bounce according to the width of the print sheet 28, a control circuit as the second embodiment shown in FIG. 11 can be utilized. In FIG. 12, a detector 66 to detect the width of the print sheet 28 is connected to the main control device 64 shown in FIG. 3. In this apparatus, when the width of the print sheet 28 is detected by the detector 66, the detected signal is input to the main control device 64. The main control device 64 has a ROM in which data table relating the width of the print sheet 28 and optimum pulse width, pulse timing is stored therein, and outputs a control command to the transistor controller 62 to read out the pulse width and the pulse timing from the ROM according to the width of print sheet 28 supported on the platen 26, whereby the optimum dot printing can be performed on the print sheet 28.

Here, for instance, the detector 66 is constructed as follows. The carriage on which the print head is mounted is supported on a eccentric shaft which can eccentrically rotate. That is to say, the print head is movable back and forth against the print sheet 28 and the distance between the print head and the print sheet 28 can be adjusted. Further, a limit switch is arranged on the back end of the movable range in which the carriage is moved back and forth, whereby the position of the carriage is detected by the limit switch.

In above construction, the carriage is moved to the back position till the limit switch detects thereof and thereafter, the carriage is moved to the forth position till the top end of the print head contacts to the print sheet 28. While forwarding the carriage, pulse number counted by a photointerruptor attached to the eccentric shaft through slits of an encoder is stored in a memory. Here, this counted pulse number corresponds to the width of the print sheet 28. And optimum data is output from the ROM according to the detected pulse number. After the width is detected, the carriage is moved backwardly to maintain optimum distance between the print head and the print sheet 28 by rotating the eccentric shaft with predetermined rotational number.

Therefore, according to the apparatus of the second embodiment, the disorder of the operation of the printing wire 24 caused by the difference in the thickness of the print sheet 28 can be dissolved by controlling the applying timing and the pulse width of the discharging pulse according to the thickness of the print sheet 28 detected through the detector 66.

The foregoing description of preferred embodiments of the invention as been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as rare suited to the particular use contemplated. It is intended that the scope of the invention be defined by the claims appended hereto, and their equivalents.

What is claimed is:

1. A dot printing apparatus including a print head performing dot printing on a print sheet by a printing wire and an actuator having a piezoelectric member connected to the printing wire for driving the printing wire, the dot printing apparatus comprising:

a supplying means for supplying electric energy to the piezoelectric member to charge thereof, a removing means for removing the electric energy from the charged piezoelectric member to discharge thereof, a judging means for judging whether dot printing data to be printed exists within a first predetermined number of printing pitches on the print sheet next to a present printing pitch, a control means for controlling the removing means based on judgement by the judging means, so that the removing means removes a part of the electric energy from the charged piezoelectric member and thereafter completely removes remainder of the electric energy therefrom.

2. The dot printing apparatus according to claim 1, wherein the removing means removes the part of the electric energy from the charged piezoelectric member if the judging means judges that the dot printing does not exist within the first predetermined number of the printing pitches.

3. The dot printing apparatus according to claim 1, wherein the removing means has a discharging circuit connected to the piezoelectric member and the control means outputs to the discharging circuit a discharging pulse with a first predetermined width corresponding to the part of the electric energy.

4. The dot printing apparatus according to claim 3, wherein the discharging circuit includes a first transistor with a base terminal and the discharging pulse is input to the base terminal.

5. The dot printing apparatus according to claim 3, wherein the discharging pulse is input to the discharging circuit after a predetermined time is elapsed since charging of the piezoelectric member through the supplying means is commenced.

6. The dot printing apparatus according to claim 3, wherein the first predetermined width of the discharging pulse lies in a range of 7 μseconds–13 μseconds.

7. The dot printing apparatus according to claim 5, wherein the predetermined time has a time length lying in a range of 80 μseconds–130 μseconds.

8. The dot printing apparatus according to claim 3, wherein the supplying means has a charging circuit connected to the piezoelectric member and the control means outputs to the charging circuit a charging pulse with a second predetermined width corresponding to the electric energy necessary to charge the piezoelectric member.

9. The dot printing apparatus according to claim 1, wherein the judging means further judges, a last dot printing mode in a continuous dot printing where the dot printing data exists within one or more printing pitches before the present printing pitch and does not exist within the one or more pitches next to the present printing pitch, and a single dot printing mode where the dot printing data does not exist within the one or more printing pitches both before and next to the present printing pitch.

10. The dot printing apparatus according to claim 9, wherein the control means outputs a discharging pulse with a third predetermined width to the removing means after a third predetermined time is elapsed since charging of the piezoelectric member is commenced in the last dot printing mode judged through the judging means and with a fourth predetermined width to the removing means after a fourth predetermined time is elapsed since the charging of the piezoelectric element is commenced in the single dot printing mode judged through the judging means.

11. The dot printing apparatus according to claim 10, wherein the third predetermined time is set shorter than the fourth predetermined time.

12. The dot printing apparatus according to claim 11, wherein the third predetermined width is set narrower than the fourth predetermined width.

13. The dot printing apparatus according to claim 12, wherein the electric energy stored in the piezoelectric member after the discharging pulse with the third predetermined width is output to the removing means is higher than that after the discharging pulse with the fourth predetermined width is output to the removing means.

14. The dot printing apparatus according to claim 1, further comprising a detector for detecting a thickness of the print sheet and the control means determines a timing of a discharging pulse to the removing means according to the thickness detected by the detector.

15. The dot printing apparatus according to claim 1, further comprising a detector for detecting a thickness of the print sheet and the control means determines a pulse width of a discharging pulse to the removing means according to the thickness detected by the detector.

16. A dot printing apparatus including a print head performing dot printing on a print sheet by a printing wire and an actuator having a piezoelectric member connected to the printing wire for driving the printing wire, the dot printing apparatus comprising:

a charging means for supplying electric energy to the piezoelectric member to charge thereof, a discharging means for removing the electric energy from the charged piezoelectric member based on a discharging pulse, a judging means for judging one of three dot printing modes comprising a last dot printing mode in a continuous dot printing where the dot printing data exists within a predetermined number of printing pitches before the present printing pitch and does not exist within the predetermined number of the printing pitches next to the present printing pitch, single dot printing mode where the dot printing data does not exist within the predetermined number of the printing pitches both before and next to the present printing pitch and a continuous dot printing mode where the dot printing data exists within the predetermined number of the printing pitches both before and next to the present printing pitch, a control means for outputting to the discharging means one of the discharging pulses which comprises;

the discharging pulse with a fifth width output after a fifth predetermined time is elapsed since charging of the piezoelectric member is commenced in the last dot printing mode judged through the judging means, the discharging pulse with a sixth width wider than the fifth width output after a sixth predetermined time longer than the fifth predetermined time is elapsed since the charging of the piezoelectric member is commenced in the single dot printing mode judged through the judging means, the discharging pulse with a seventh width wider than both the fifth and sixth width after the fifth predetermined time is elapsed since the charging of the piezoelectric member is commenced in the continuous dot printing mode judged through the judging means.

* * * * *